US010722931B2

(12) United States Patent
Mevissen et al.

(10) Patent No.: US 10,722,931 B2
(45) Date of Patent: Jul. 28, 2020

(54) PLATE STRETCHER AND PLATE STRETCHING METHOD

(71) Applicant: SMS group GmbH, Duesseldorf (DE)

(72) Inventors: Peter Mevissen, Moenchengladbach (DE); David Huesgen, Moenchengladbach (DE)

(73) Assignee: SMS Group GmbH, Duesseldorf (DE)

( * ) Notice: Subject to any disclaimer, the term of this patent is extended or adjusted under 35 U.S.C. 154(b) by 451 days.

(21) Appl. No.: 15/460,359

(22) Filed: Mar. 16, 2017

(65) Prior Publication Data

US 2017/0274439 A1 Sep. 28, 2017

(30) Foreign Application Priority Data

Mar. 22, 2016 (DE) ..... 10 2016 105 306

(51) Int. Cl.
*B21D 25/04* (2006.01)

(52) U.S. Cl.
CPC ..... *B21D 25/04* (2013.01)

(58) Field of Classification Search
CPC ..... B21D 25/00; B21D 25/04; B21D 3/12
See application file for complete search history.

(56) References Cited

U.S. PATENT DOCUMENTS 3,257,832 A * 6/1966 Harvey ..... B21D 3/12 72/183
3,803,899 A 4/1974 Hertl et al.
4,459,838 A * 7/1984 Kutz ..... B21D 25/04 33/520
4,706,486 A * 11/1987 Kan ..... B21D 25/02 269/152
8,490,454 B2 * 7/2013 Beltran De Nanclares Echezarreta ..... B21D 22/22 72/296
9,221,089 B2 * 12/2015 Lee ..... B21D 25/04
2007/0163323 A1 * 7/2007 Polen ..... B21D 25/04 72/302

FOREIGN PATENT DOCUMENTS

CN 104438457 A 3/2015
CN 204953574 U 1/2019
DE 1 602 551 A1 3/1971
DE 2 026 521 A1 12/1971
DE 32 04 560 A1 10/1982
DE 10 2007 009 139 B3 9/2008
(Continued)

OTHER PUBLICATIONS

Chinese Office Action dated Aug. 31, 2018 in Chinese Application No. 201710165291.3.

(Continued)

*Primary Examiner* — Teresa M Ekiert
(74) *Attorney, Agent, or Firm* — Collard & Roe, P.C.

(57) ABSTRACT

A plate stretcher includes two clamping heads that are directed at one another and can be displaced relative to one another, to apply a clamping force directed along a stretching direction, by way of a pressure element that absorbs the clamping force, and at least one transverse straightener that acts perpendicularly to the clamping force. A method for stretching a plate in a plate stretcher transversely straightens the plate during stretching of the plate.

12 Claims, 2 Drawing Sheets

(56) References Cited

FOREIGN PATENT DOCUMENTS

GB 2 446 921 A 8/2008

OTHER PUBLICATIONS

German Office Action dated Nov. 21, 2016 in German Application No. 10 2016 105 306.6 with English translation of relevant parts.
English Translation of Chinese Third Office Action in Chinese Application No. 201710165291.3 dated Oct. 9, 2019.

* cited by examiner

PLATE STRETCHER AND PLATE STRETCHING METHOD

CROSS REFERENCE TO RELATED APPLICATIONS

Applicant claims priority under 35 U.S.C. § 119 of German Application No. 10 2016 105 306.6 filed Mar. 22, 2016, the disclosure of which is incorporated by reference.

BACKGROUND OF THE INVENTION

1. Field of the Invention

The invention relates to a plate stretcher comprising two chuck heads that are directed at one another and can be displaced relative to one another, to apply a clamping force directed along a stretching direction, by way of a pressure element that absorbs the clamping force. Likewise, the invention relates to a method for stretching a plate in a plate stretcher.

2. Description of the Related Art

Such plate stretchers are known, for example, from DE 10 2007 009 139 B3, from DE 32 04 560 A1, or from DE 20 26 521 A1, and generally have two chuck heads that are directed at one another and can be displaced relative to one another to apply a clamping force directed along a stretching direction. In this regard, they particularly serve for stretching and/or straightening rolled or pressed stretched material. In particular, they serve for stretching and/or straightening metal sheets or plates. In this regard, at least one of the chuck heads can comprise lamellae oriented perpendicular to a clamping plane for the workpieces to be clamped. These lamellae then carry a clamping mouth or some other type of clamping jaws, for example. Likewise, the respective workpieces can be clamped in place in some other way, using the clamping jaws that cause the chuck head to clamp, for example by means of wedges that run at a slant or the like.

SUMMARY OF THE INVENTION

It is an object of the present invention to improve a plate stretcher of the stated type and a plate stretching method of the stated type with regard to its straightening possibility.

These and other objects are accomplished by a plate stretcher and by a plate stretching method having the characteristics according to the invention. Further advantageous embodiments, if applicable also independent of these characteristics, are found in the following description.

Thus, in the case of a plate stretcher that has two chuck heads that are directed at one another and can be displaced relative to one another, to apply a clamping force directed along a stretching direction, by way of a pressure element that absorbs the clamping force, the straightening possibilities can be improved if the plate stretcher is characterized by at least one transverse straightener that acts perpendicular to the clamping force.

Likewise, cumulatively or alternatively, the straightening possibilities can be improved in a method for stretching a plate in a plate stretcher, if this method is characterized in that the plate is transversely straightened during stretching of the plate.

By means of the chuck heads of the plate stretcher, force can be exerted in the stretching direction on the respective workpiece, such as, in particular, a metal sheet or a plate. A transverse straightener, on the other hand, is able to exert forces perpendicular to this stretching direction on the workpiece, so that straightening forces can be applied in targeted manner by the straightener, perpendicular to the workpieces and thereby also perpendicular to a clamping plane of these workpieces between the chuck heads, in order to be able to straighten the plate supplementally to any straightening brought about by the stretching. Preferably, transverse straightening can take place during the stretching process, because here, flow processes and deformation processes already occur in the workpiece, i.e. in the plate or the metal sheet, due to the stretching, so that the forces required for transverse straightening are correspondingly lower.

Pressure columns, which are frequently, as disclosed in DE 32 04 560 A1 or DE 20 26 521 A1, for example, disposed in pairs between the chuck heads, preferably in the clamping plane, are particular possibilities as pressure elements. Likewise, however, walls or a floor, or also further pressure columns or the like can be used as pressure elements.

In order to be able to work with different workpiece lengths or plate lengths or metal sheet lengths, at least one of the chuck heads can be locked into the pressure element in different positions, as particularly disclosed in DE 32 04 560 A1, and this locking can happen with force fit, for example, by way of nuts, spindles, or by way of bayonet bushings. Likewise, shape-fit connections, for example by way of bolts and holes, can be provided. De 32 04 560 A1 discloses gear teeth for a particularly precise adjustment possibility.

Depending on the concrete embodiment of the plate stretcher, both chuck heads can be moved during stretching, which ultimately results in a lesser stroke of the individual chuck head. Frequently, however, a fixed chuck head as well as a chuck head that is mounted so as to be displaceable, in contrast, is used as a counter chuck head, wherein—depending on the concrete implementation—it is advantageous if the counter chuck head can also be locked on the pressure element in different positions, while the displacement by way of which the clamping force is generated takes place in the region of the connection between the pressure element and the fixed chuck head. This arrangement has the advantage that the corresponding drive apparatuses, such as hydraulic cylinders and the like, for example, are provided on modules that are fixed in place or' almost fixed in place.

As has already been disclosed in DE 20 26 521 A1, the plate stretcher can comprise a centering unit in order to ensure that the center of the workpiece to be elongated or to be stretched agrees with the center of the plate stretcher when a workpiece or a plate is to be placed in the plate stretcher.

In general, these workpieces are extremely heavy and are transported by indoor cranes and similar devices, lowered onto the plate stretcher, and still held during centering. Displacement in the stretching direction of the plate stretcher, at the corresponding centering unit, can be arranged to be low in friction and low in wear by way of centering rollers. Lateral straightening can take place by means of lateral centering jaws or the like, for example.

After centering or positioning, the chuck heads or the one counter chuck head can then be moved accordingly, so that the workpiece can be clamped in place using the chuck heads. Accordingly, such a centering unit is preferably disposed on one side of at least a first one of the two chuck heads, wherein this side faces the other chuck head.

In this manner, the workpiece can easily be introduced into the chuck head mouth of the respective chuck head, in other words into the opening of the chuck head that faces the workpiece. Alternatively, the chuck head can easily be moved over the workpiece or the plate while the workpiece is at rest and the chuck head is moving.

In this regard, it is conceivable that the centering unit is removed again after centering and clamping of the workpiece with the chuck head, or possibly also moved to the other chuck head and used accordingly there. On the other hand, as DE 20 26 521 A1 also particularly discloses, the centering unit is preferably carried by the first of the two chuck heads, so that it remains on the respective chuck head even during the stretching process.

It is understood that particularly in this embodiment, it is advantageous if each of the chuck heads carries a corresponding centering unit.

If such a centering unit is provided, it is advantageous if the transverse straightener is disposed between the centering unit and at least one clamping jaw provided on the first of the two chuck heads. This arrangement makes it possible to straighten the plate transversely extremely close to its end facing the respective chuck head, and this feature is particularly advantageous with regard to plates or workpieces that have an increased need for straightening at their ends. In practice, it has been shown that this increased need is fairly frequently the case. In this manner, very effective straightening is thereby possible, above all, also over a workpiece length or plate length that is as great as possible.

An improvement in the straightening possibility also particularly takes place if the plate is transversely straightened between a centering unit provided on a chuck head and at least one clamping jaw provided on the chuck head.

Independent of the presence of a centering unit, it is advantageous if the transverse straightener reaches all the way into a chuck head mouth of one of the chuck heads. In this way, too, the workpiece length or plate length that can be effectively grasped by way of the transverse straightener can be maximized.

Depending on the specific embodiment, the transverse straightener can have multiple transverse straightening units that act for transverse straightening. Preferably, such transverse straightening units are transverse straightening presses that can act on the workpieces or plates for transverse straightening, in an action direction that acts on the workpieces in the direction perpendicular to the clamping plane of the workpieces. In particular, the transverse straightener can thereby comprise multiple transverse straightening presses with a corresponding direction of action. In this regard, it is understood that the respective transverse straightening presses, if applicable, can act on the respective workpiece with an opposite direction of action, in other words, for example, from above or below, or, for example, from opposite sides of the clamping plane.

Preferably, at least one transverse straightening press of the transverse straightener is disposed on one of the chuck heads, something that allows corresponding straightening processes in the region of the end of the plate facing the respective chuck head, in structurally simple manner. Also, in this way, a transverse straightener can be made available, in structurally simple manner, which is disposed between the centering unit and at least one of the clamping jaws or reaches all the way into the chuck head mouth of the corresponding chuck head. It is understood that the transverse straightener can also have further transverse straightening presses, for example transverse straightening presses that act independent of the chuck heads, between the same, or transverse straightening presses at the other one of the two chuck heads, supplementally to this.

Preferably, the transverse straightener comprises at least two transverse straightening presses, each having a direction of action, which directions have an opposite component. This arrangement makes it possible that even more complex straightening processes can be carried out quickly and easily. If applicable, however, it is also conceivable to orient the transverse straightening presses not in pairs with opposite directions of action, but rather to orient specific transverse straightening presses only in one direction, standing alone, because a plate or workpiece, if applicable, if it is supposed to be transversely straightened in a specific direction, can also be clamped with the chuck heads in a correspondingly turned position with reference to the clamping plane.

In particular, it has proven to be advantageous if at least two transverse straightening presses with respective directions of action that have an opposite component are provided on at least one of the two chuck heads. Preferably, such transverse straightening presses with directions of action directed opposite one another or with directions of action that have an opposite component are provided on both chuck heads. With regard to possible transverse straightening presses in the region between the chuck heads, in contrast, it can be sufficient if transverse straightening presses that act only in one direction of action or even only a single transverse straightening press is provided, accordingly.

The transverse straightener can have at least one straightening bar divided perpendicular to its direction of action and perpendicular to the stretching direction. In this regard, it is then advantageous if each element of the straightening bar can be adjusted individually, so that even complex twists can be straightened in targeted manner. Depending on the concrete requirements, it is also conceivable that here, individual elements cannot be positioned here, or can be positioned only if they are coupled. Corresponding ability to be positioned can be guaranteed by way of separate cylinders, particularly by way of separate short-stroke cylinders, for example.

Preferably, the transverse straightener can be displaced parallel to the stretching direction. Depending on the concrete embodiment of the plate stretcher, it is advantageous if at least one transverse straightening press of the transverse straightener can be displaced parallel to the stretching direction. Such displaceability makes it possible, on the one hand, to position the transverse straightener or the transverse straightening press in suitable manner in the stretching direction, with reference to the workpiece, in order to thereby be able to act on the workpiece to straighten it, in targeted manner. In this manner, different deformations of the workpiece or of the plate can be correspondingly taken into account in targeted manner. On the other hand, this displaceability enables the transverse straightener or its transverse straightening press to follow a movement of the workpiece or of the plate during stretching, so that the dimension of a relative movement between the transverse straightener and the workpiece and thereby the risk of undesirable markings or damage can be reduced to a minimum.

Accordingly, it is advantageous if a transverse straightener used for transverse straightening follows a movement of the plate during stretching, in the stretching direction, in order to reduce the risk of damage and markings to a minimum.

Corresponding following or displaceability of the transverse straightener or individual transverse straightening presses can take place with a motor, on the one hand, thereby facilitating corresponding positioning of the respective modules. Particularly during stretching, following or the corresponding displacement can also take place freely. Such fee following can happen, for example, in that the plate being stretched or the workpiece being stretched takes the transverse straightener or the corresponding modules along with it. Such free following allows a reduction of the risk of markings or damage of the workpiece, without complex controllers or regulators being necessary.

It is understood that displaceability in the stretching direction or following of the transverse straightener in the stretching direction does not necessarily bring about the result that all the modules or all the transverse straightening presses must be displaced or are displaced in the same way and to the same extent. Instead, it is advantageous if each module of the transverse straightener, which individually comes into contact with the workpiece or the plate to straighten it, can also be individually displaced in the stretching direction. In this regard, it is understood that modules that enter into interaction parallel to the stretching direction, at the same level with the workpiece or the plate, can also be configured so that they can be displaced jointly, something that particularly holds true in the case of a divided straightening bar or for the individual elements of a straightening bar.

It is understood that the characteristics of the solutions described above and in the claims can also be combined, if applicable, in order to be able to implement the advantages cumulatively, accordingly.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

IN THE DRAWINGS

Figure 1:
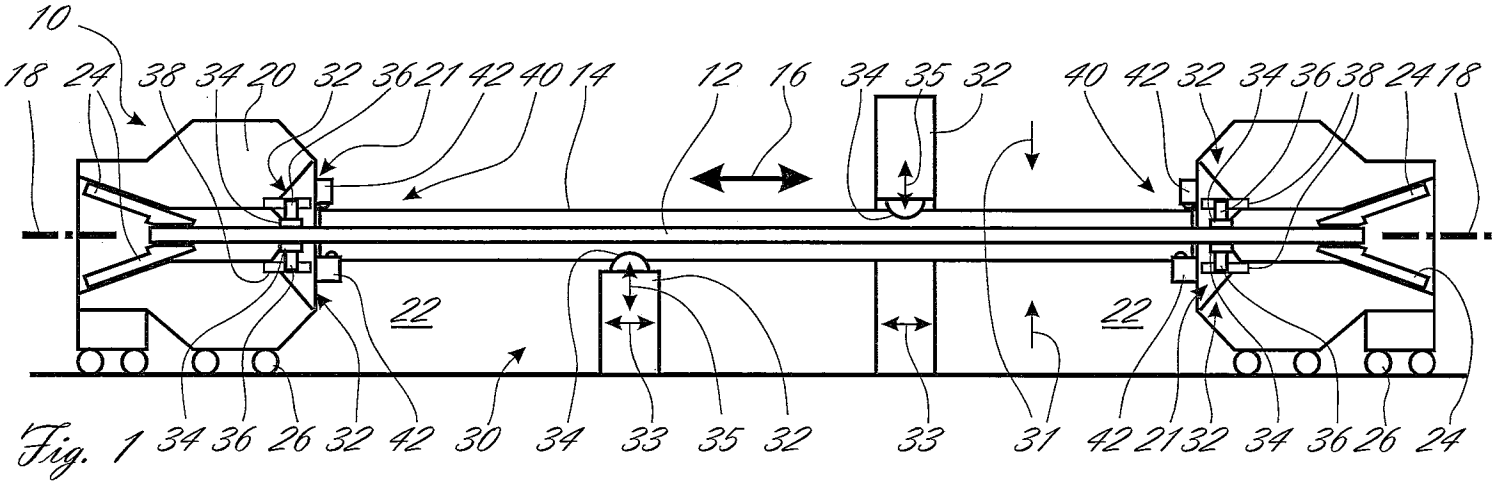
Figure 2:
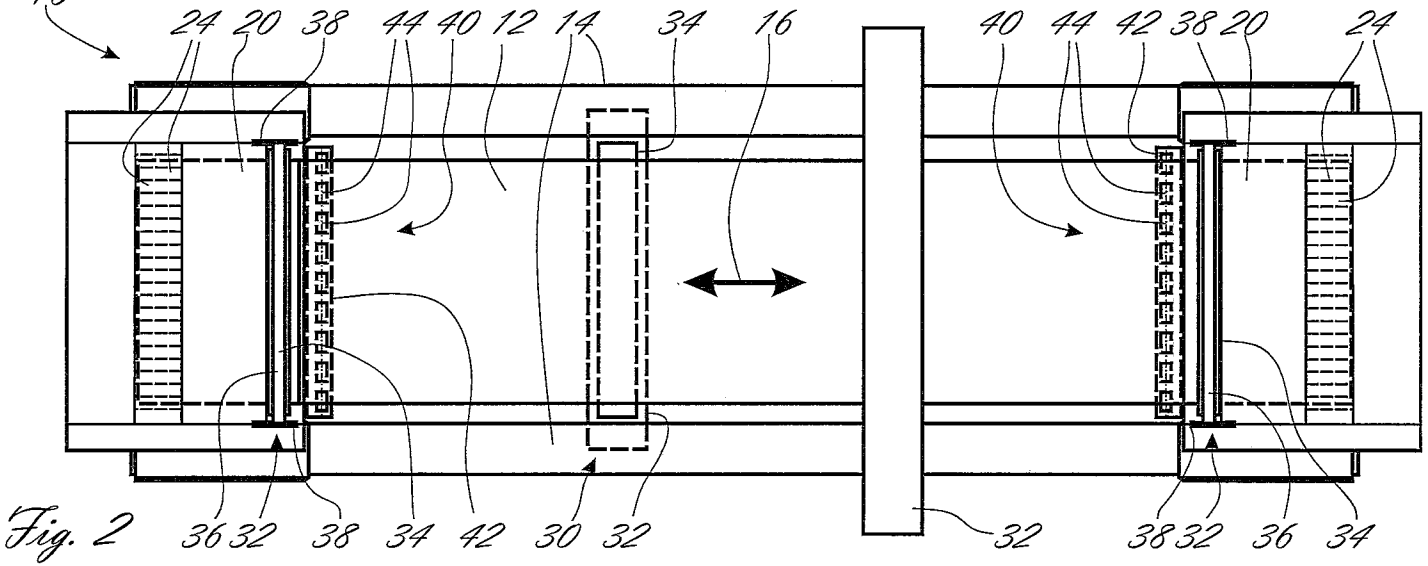
Figure 3:
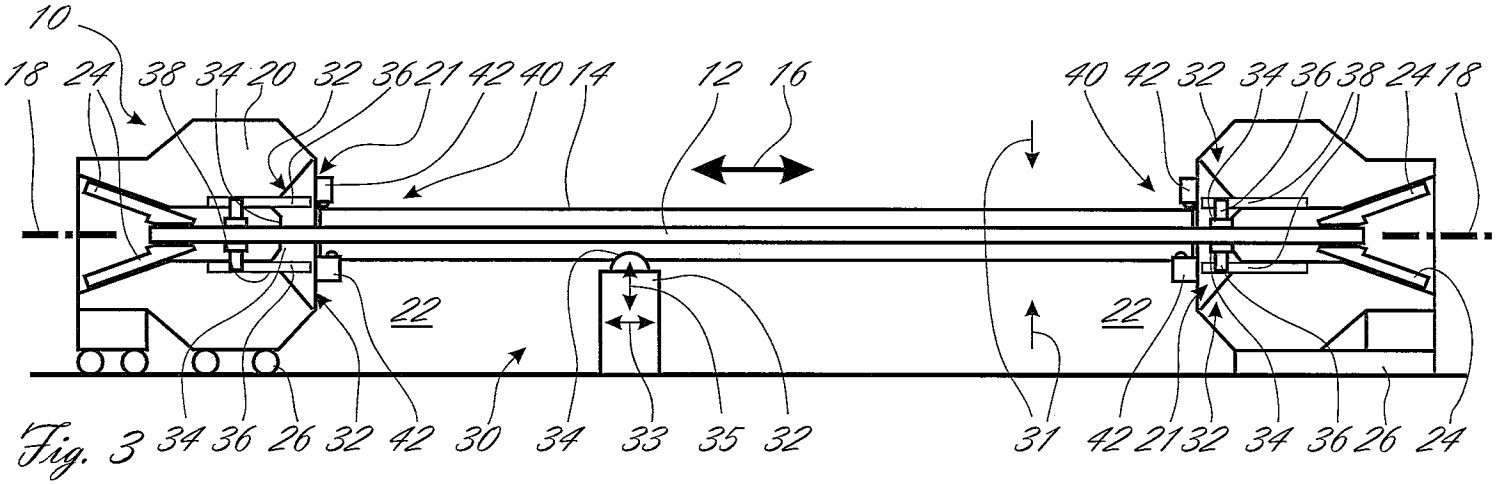

FIG. 1 shows a first plate stretcher in a schematic side view;

FIG. 2 shows the plate stretcher according to FIG. 1 in a schematic top view;

FIG. 3 shows a second plate stretcher in a schematic side view; and

Figure 4:
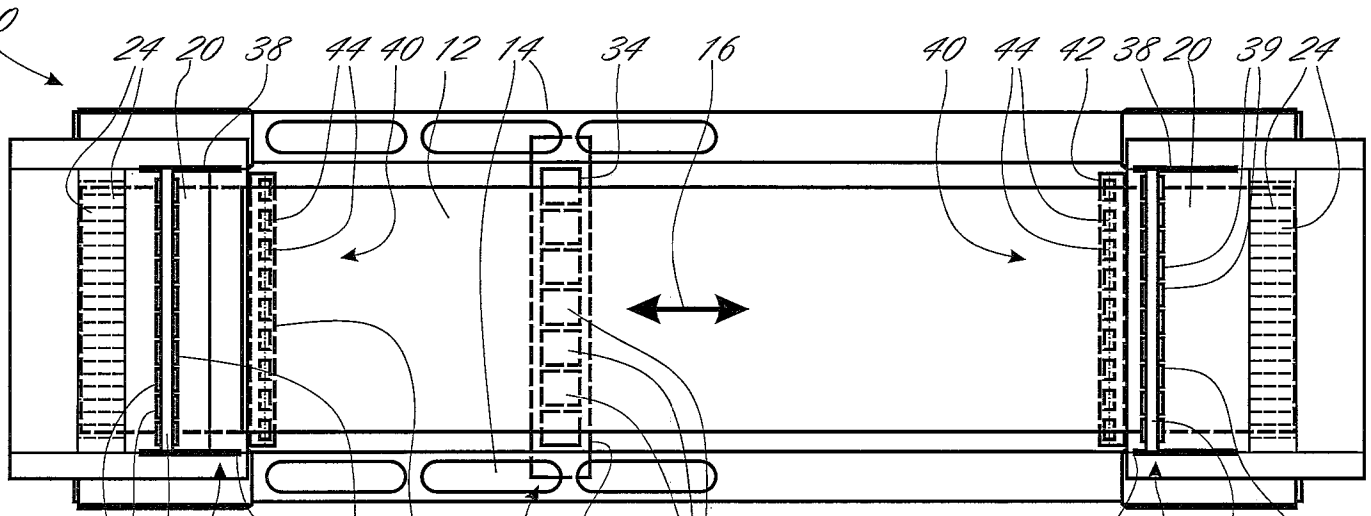

FIG. 4 shows the plate stretcher according to FIG. 3 in a schematic top view.

DETAILED DESCRIPTION OF PREFERRED EMBODIMENTS

The plate stretchers 10 shown in the figures comprise two clamping or chuck heads 20, each having sides 22 that are directed at one another.

The chuck heads 20 are displaceable relative to one another; this displaceability is shown symbolically by means of wheels 26 here. In this regard, both chuck heads 20 are displaceable in the exemplary embodiment according to FIGS. 1 and 2, while in the exemplary embodiment according to FIGS. 3 and 4, one of the chuck heads 20 is configured to be fixed in place, and the other of the two chuck heads 20 is configured to be displaceable, as a counter chuck head. It is understood that ultimately, depending on the concrete implementation of these exemplary embodiments, other displacement possibilities can also be provided for deviating exemplary embodiments, and, in particular, mounting possibilities deviating from wheels 26 can also be provided, and that in deviating exemplary embodiments, the displacement possibilities of the two exemplary embodiments according to FIGS. 1 to 4 can also be interchanged.

The clamping or chuck heads 20 each have a clamping or chuck head mouth 21 that opens toward the side 22 of the chuck heads 20 that faces the other chuck head 20, in each instance, by means of which the chuck heads 20 can hold a plate 12 or other workpieces to be stretched, such as metal sheets or the like.

In the chuck head mouth 21, clamping jaws 24 are provided on both sides of a clamping plane 18, by way of which jaws the plate 12 or the workpieces can be clamped using the chuck heads 20, in each instance.

In the case of both exemplary embodiments, the chuck heads 20 are connected to act with pressure bars 14 that are provided parallel to one another in the clamping plane 18, on both sides of the chuck heads 20, and form the pressure element in these exemplary embodiments.

Not shown, because they are sufficiently known from the state of the art, are drives by means of which the chuck heads 20 can be displaced relative to one another. Usually, motor-driven, particularly hydraulic drives are provided here, which displace at least one of the chuck heads 20 relative to the pressure element in the stretching direction 16, which lies in the clamping plane 18. It is understood that in the case of deviating embodiments of the pressure element, other types of drives are also provided, wherein ultimately, the only important thing is that the chuck heads 20 are displaced relative to one another to apply a clamping force in the stretching direction 16. Ultimately, in the present connection it only plays a subordinate role in what way this displacement is brought about or how the stretching or clamping force that acts in the stretching direction 16 is applied or compensated.

In the exemplary embodiment shown in FIGS. 3 and 4, the pressure bars 14 have openings that are not numbered but are shown in the drawing, by way of which openings the displaceable chuck head 20 can be locked onto the pressure bar 14 at different distances from the other chuck head 20. The same can also be provided in the exemplary embodiment provided in FIGS. 1 and 2. Also, in this regard, other adjustment possibilities, such as spindles, wedge connections, gear teeth, and the like, can also be provided in deviating embodiments.

Both of the plate stretchers 10 shown in the figures each have centering units 40 that are disposed ahead of the chuck head mouth 21 of the chuck heads 20, in each instance. It is understood that in deviating embodiments, such centering devices or others can also be provided at a different location or in movable form.

The centering units 40 each have centering bars 42 disposed on both sides of the clamping plane 18, which bars each carry centering rollers 44, thereby making it simpler to center a plate 12 or another workpiece that is supposed to be applied to the plate stretcher 10, in each instance, with reference to the clamping plane 18, before the plate 12 gets into the respective chuck head mouth 21 all the way to the clamping jaws 24. In this regard, the centering rollers 44 serve to prevent undesirable markings on the respective workpiece or on the plate 12. It is understood that here, deviating solutions can easily be used accordingly in deviating embodiments, if applicable. In particular, it is conceivable, for example, to provide a centering bar 42 only on the underside or only on one side of the clamping plane 18.

Likewise, transverse centering units, which are not shown here but are sufficiently known from the state of the art, by means of which the plate 12 or the workpiece can be centered in the clamping plane 18 and, in particular, perpendicular to the stretching direction 16, can be provided.

Both of the plate stretchers 10 shown in the figures have a transverse straightener 30 that is indicated merely by a general arrow, because it extends almost over the entire plate stretcher 10 with its different modules.

In detail, the transverse straighteners 30 of the two plate stretchers 10 shown in the figures comprise transverse straightening presses 32 that can act on the plate 12 or the corresponding workpiece in different directions of action 31 with reference to the clamping plane 18.

The transverse straightening presses 32 are, among other things, two transverse straightening presses 32, in each instance, that are provided in the two chuck heads 20 with opposite directions of action 31. Supplementally, the plate stretcher 10 shown in FIGS. 1 and 2 has two transverse straightening presses 32 that can act on the plate 12 or on a workpiece with opposite directions of action 31 in the interstice between the two chuck heads 20. In the exemplary embodiment shown in FIGS. 3 and 4, in contrast, only one transverse straightening press 32 is provided in the interstice between the two chuck heads 20, which press can act on the plate 12 or a workpiece in only one direction, in the present exemplary embodiment from below, but this action can also take place from above, if applicable. Taking place from above is non-critical in that if applicable, the plate 12 or the corresponding workpiece can also be clamped in the plate stretcher 10 in turned manner, if transverse straightening is supposed to take place from the other side of the plate 12 or of the workpiece. It is understood that also in the case of the exemplary embodiment according to FIGS. 3 and 4, the arrangement of the transverse straightening presses 32 of the exemplary embodiment according to FIGS. 1 and 2 can be provided—and vice versa. Likewise, it is understood that individual transverse straightening presses can be left out on the chuck heads if these presses are considered unnecessary in an individual case.

All of the transverse straightening presses that are shown in the present exemplary embodiments each have a straightening bar 34 that can be positioned perpendicular to the clamping plane 18 in the positioning direction 35 (merely shown in detail with regard to the larger transverse straightening presses 32). In this manner, transverse straightening processes can be easily carried out accordingly, in each instance. In the case of the present exemplary embodiments, positioning takes place by means of corresponding cylinders or cylinder/piston units. Depending on the concrete implementation, short-stroke cylinders are possible in this regard, particularly for the transverse straightening presses 32 that are provided on the chuck heads 20.

The transverse straightening presses 32 disposed on the chuck heads 20 have supports 36 that carry the straightening bar 34, on the one hand, and the means for positioning the straightening bar 34, such as the short-stroke cylinders, for example, on the other hand. The supports can furthermore be displaced on the chuck heads 20 by way of rails 38, so that on the one hand, they can be positioned in targeted manner for transverse straightening, and on the other hand they can follow possible material movements of the plate 12 or of the workpiece during stretching. The rails 38 are accordingly oriented parallel to a displacement direction 33, wherein the other transverse straightening presses 32 can also be displaced along the displacement direction 33, something that is correspondingly advantageous.

In this regard, in the exemplary embodiment according to FIGS. 3 and 4 the path length that the rails 38 make possible is configured to be longer than in the exemplary embodiment according to FIGS. 1 and 2. It is understood that depending on the concrete requirements, a corresponding path length can be made possible.

If applicable, it is also possible to do without a displacement, particularly during the stretching process, if the relative movement to be expected between the respective transverse straightening press 32 and the plate 12 or the workpiece is very slight. This case occurs, for example, if the transverse straightening press 32 is disposed very close to the clamping jaws 24 or also precisely in the middle between the two chuck heads 20 of the plate stretcher 10 according to FIGS. 1 and 2.

In deviating embodiments, positioning of the transverse straightening presses 32, which is provided on the chuck heads 20, can also take place in that the rails 38, in which the support 36 or actually the straightening bar 34 then runs, can be positioned accordingly.

In the case of the plate stretcher 10 shown in FIGS. 3 and 4, the straightening bars 34 of the transverse straightening press 32 are furthermore configured to be divided, and have individual elements 39. It is understood that this feature can also be provided, only for individual transverse straightening presses 32 of the corresponding plate stretcher 10, in the case of deviating exemplary embodiments. Likewise, this feature can also be provided in the case of the arrangement according to FIGS. 1 and 2, for one or individual ones of the transverse straightening presses 32 or also for all the transverse straightening presses 32.

In this regard, the individual elements 39 can also be positioned by means of individual cylinders, more precisely by means of individual short-stroke cylinders. Particularly in the case of transverse straightening presses 32 that are provided between chuck heads 20 and not on chuck heads 20, other cylinders or supplementally, cylinders for greater strokes can also be provided. It is understood that if applicable, multiple of the individual elements 39 can also be coupled, for example coupled hydraulically. Likewise, it is conceivable that individual elements 39 are also structured to be rigid, but this arrangement appears to be conceivable only for special cases, for example for elements on the lateral edge of the chuck head mouth 21.

Although only a few embodiments of the present invention have been shown and described, it is to be understood that many changes and modifications may be made thereunto without departing from the spirit and scope of the invention.

What is claimed is:

1. A plate stretcher comprising:

(a) a pressure element;

(b) first and second chuck heads directed at and displaceable relative to one another along a stretching direction for applying a clamping force by way of the pressure element that absorbs the clamping force, wherein the first chuck head has a first chuck head mouth and the second chuck head has a second chuck head mouth facing the first chuck head mouth, and wherein the pressure element is connected to the first chuck head or the second chuck head;

(c) first and second centering units, wherein the first centering unit is disposed on a first side of the first chuck head facing the second chuck head mouth, and wherein the second centering unit is disposed on a second side of the second chuck head facing the first chuck head mouth; and (d) at least one transverse straightener that acts perpendicularly to the clamping force, wherein the transverse straightener is displaceable parallel to the stretching direction;

wherein the first centering unit is carried by the first chuck head; and wherein the transverse straightener is disposed between the first centering unit and at least one clamping jaw provided on the first chuck head.

2. A plate stretching method for stretching a plate in the plate stretcher according to claim 1, the plate stretcher serving for stretching and/or straightening rolled or pressed stretched material, the method comprising:

(a) stretching the plate; and (b) transversely straightening the plate during stretching of the plate.

3. The plate stretching method according to claim 2, wherein the at least one transverse straightener is used for transverse straightening and wherein the at least one transverse straightener follows a movement of the plate during stretching, in a stretching direction.

4. The plate stretching method according to claim 3, wherein the at least one transverse straightener freely follows the movement of the plate during stretching.

5. The plate stretching method according to claim 2, wherein the plate is transversely straightened between the first centering unit provided on the first chuck head and at least one clamping jaw provided on the first chuck head.

6. The plate stretcher according to claim 1, further comprising rails oriented parallel to a displacement direction, wherein the at least one transverse straightener is supported on the rails.

7. A plate stretcher comprising:

(a) a pressure element;

(b) first and second chuck heads directed at and displaceable relative to one another along a stretching direction for applying a clamping force by way of the pressure element that absorbs the clamping force, wherein the pressure element is connected to the first chuck head or the second chuck head;

(c) a first transverse straightener that acts perpendicularly to the clamping force; and (d) a second transverse straightener that acts perpendicularly to the clamping force, the second transverse straightener being displaceable along the displacement direction.

8. A plate stretcher comprising:

(a) a pressure element;

(b) first and second chuck heads directed at and displaceable relative to one another along a stretching direction for applying a clamping force by way of the pressure element that absorbs the clamping force, wherein the first chuck head has a first chuck head mouth and the second chuck head has a second chuck head mouth facing the first chuck head mouth, and wherein the pressure element is connected to the first chuck head or the second chuck head;

(c) first and second centering units, wherein the first centering unit is disposed on a first side of the first chuck head facing the second chuck head mouth, and wherein the second centering unit is disposed on a second side of the second chuck head facing the first chuck head mouth; and (d) at least one transverse straightener that acts perpendicularly to the clamping force, wherein the transverse straightener is displaceable parallel to the stretching direction;

wherein the transverse straightener extends into the first chuck head mouth of the first chuck head.

9. A plate stretcher comprising:

(a) a pressure element;

(b) first and second chuck heads directed at and displaceable relative to one another along a stretching direction for applying a clamping force by way of the pressure element that absorbs the clamping force, wherein the first chuck head has a first chuck head mouth and the second chuck head has a second chuck head mouth facing the first chuck head mouth, and wherein the pressure element is connected to the first chuck head or the second chuck head;

(c) first and second centering units, wherein the first centering unit is disposed on a first side of the first chuck head facing the second chuck head mouth, and wherein the second centering unit is disposed on a second side of the second chuck head facing the first chuck head mouth; and (d) at least one transverse straightener that acts perpendicularly to the clamping force, wherein the transverse straightener is displaceable parallel to the stretching direction;

wherein the transverse straightener comprises at least one transverse straightening press that is disposed on the first chuck head.

10. The plate stretcher according to claim 9, wherein the at least one transverse straightening press is displaceable parallel to the stretching direction.

11. A plate stretcher comprising:

(a) a pressure element;

(b) first and second chuck heads directed at and displaceable relative to one another along a stretching direction for applying a clamping force by way of the pressure element that absorbs the clamping force, wherein the first chuck head has a first chuck head mouth and the second chuck head has a second chuck head mouth facing the first chuck head mouth, and wherein the pressure element is connected to the first chuck head or the second chuck head;

(c) first and second centering units, wherein the first centering unit is disposed on a first side of the first chuck head facing the second chuck head mouth, and wherein the second centering unit is disposed on a second side of the second chuck head facing the first chuck head mouth; and (d) at least one transverse straightener that acts perpendicularly to the clamping force, wherein the transverse straightener is displaceable parallel to the stretching direction;

wherein the transverse straightener comprises at least first and second transverse straightening presses having respective opposite directions of action.

12. A plate stretcher comprising:

(a) a pressure element;

(b) first and second chuck heads directed at and displaceable relative to one another along a stretching direction for applying a clamping force by way of the pressure element that absorbs the clamping force, wherein the first chuck head has a first chuck head mouth and the second chuck head has a second chuck head mouth facing the first chuck head mouth, and wherein the pressure element is connected to the first chuck head or the second chuck head;

(c) first and second centering units, wherein the first centering unit is disposed on a first side of the first chuck head facing the second chuck head mouth, and wherein the second centering unit is disposed on a second side of the second chuck head facing the first chuck head mouth; and (d) at least one transverse straightener that acts perpendicularly to the clamping force, wherein the transverse straightener is displaceable parallel to the stretching direction;

wherein the transverse straightener has at least one straightening bar having a direction of action, wherein the at least one straightening bar is divided perpendicularly to the direction of action and perpendicularly to the stretching direction.

* * * * *